US007836526B2

(12) United States Patent
Toye et al.

(10) Patent No.: US 7,836,526 B2
(45) Date of Patent: Nov. 23, 2010

(54) NEGATIVE OR VANISHING EDGE FOR SPAS AND/OR HOT TUBS

(75) Inventors: Reginald Toye, Surrey (CA); Donald Alfred Elkington, Surrey (CA)

(73) Assignee: Coast Spas Manufacturing Inc., Langley (CA)

( * ) Notice: Subject to any disclaimer, the term of this patent is extended or adjusted under 35 U.S.C. 154(b) by 482 days.

(21) Appl. No.: 10/079,836

(22) Filed: Feb. 19, 2002

(65) Prior Publication Data

US 2003/0154544 A1 Aug. 21, 2003

(51) Int. Cl.
*E04H 4/12* (2006.01)

(52) U.S. Cl. ..... 4/508; 4/509; 4/541.1

(58) Field of Classification Search ..... 4/508, 4/510, 507, 509, 512, 541.1, 584, 511, 679; D24/204, 205

See application file for complete search history.

(56) References Cited

U.S. PATENT DOCUMENTS

| | | | | | |
|---|---|---|---|---|---|
| 2,809,752 | A | * | 10/1957 | Leslie | 4/508 X |
| 3,490,081 | A | * | 1/1970 | Ogden | 4/510 |
| 3,537,111 | A | * | 11/1970 | Whitten, Jr. | 4/508 |
| 3,720,964 | A | * | 3/1973 | Thomson | 4/510 |
| 3,815,160 | A | * | 6/1974 | Baker | 4/510 |
| 4,099,272 | A | | 7/1978 | Sowder | 4/590 |
| 4,224,700 | A | | 9/1980 | Bloys | 4/603 |
| 4,246,663 | A | * | 1/1981 | Aragona et al. | 4/500 |
| 4,530,120 | A | * | 7/1985 | Etani | 4/541.3 |
| 4,627,118 | A | * | 12/1986 | Baker | 4/510 |
| 4,823,409 | A | | 4/1989 | Gaffney et al. | 4/678 |
| 4,837,870 | A | * | 6/1989 | Wiley | 4/508 X |
| 4,881,280 | A | | 11/1989 | Lesikar | 4/507 |
| 5,115,974 | A | | 5/1992 | Tobias et al. | 239/23 |
| 5,127,111 | A | | 7/1992 | Sieth | 4/591 |
| 5,167,368 | A | | 12/1992 | Nash | 239/17 |
| 5,249,744 | A | | 10/1993 | Ruthenberg | 239/23 |
| 5,309,581 | A | | 5/1994 | Lockwood et al. | 4/507 |
| 5,367,723 | A | * | 11/1994 | Pleva et al. | 4/508 |
| 5,441,529 | A | | 8/1995 | Dorsch | 607/82 |
| 5,537,696 | A | | 7/1996 | Chartier | 4/507 |
| 5,720,056 | A | * | 2/1998 | Aymes | 4/507 |
| 5,738,280 | A | | 4/1998 | Ruthenberg | 239/17 |
| 5,852,835 | A | | 12/1998 | Steinhardt et al. | 4/541.6 |
| 5,893,179 | A | | 4/1999 | Johnson | 4/507 |
| 6,134,722 | A | | 10/2000 | Lowry et al. | 4/541.1 |
| 6,152,381 | A | | 11/2000 | Hones | 239/17 |
| 6,170,094 | B1 | | 1/2001 | Weise et al. | 4/507 |
| 6,210,568 | B1 | * | 4/2001 | Harder | 4/507 |

* cited by examiner

*Primary Examiner*—Robert M Fetsuga
(74) *Attorney, Agent, or Firm*—Vermette & Co.

(57) ABSTRACT

A hot tub or spa (100) has a vanishing or overflow edge (110) not readily visible to a user. Water from the main holding area (101) overflows the edge (110) into a catch basin (102). A reservoir (120) holds a constant head of water to provide to a pump (112) and also allows for the holding of increased amounts of water displaced by users who are using the hot tub (100). Water flowing over the vanishing edge (110) flows into the catch basin (102) and thence to the reservoir (120) and pump (112) where the water is recirculated into the spa (100).

6 Claims, 4 Drawing Sheets

NEGATIVE OR VANISHING EDGE FOR SPAS AND/OR HOT TUBS

INTRODUCTION

This invention relates to spas or hot tubs and, more particularly, to the use of a negative or vanishing edge with a spa or hot tub which may be transported and is portable from a manufacturing to an installation location.

BACKGROUND OF THE INVENTION

The use of a "vanishing edge" as a portion of the perimeter of a swimming pool is known. This vanishing edge, also known as a "negative edge" is actually a lip which forms a portion of the edge of the pool. Water within the pool cascades gently over the edge and into a receiving area where the water is recirculated back into the swimming pool. The attractive feature of the negative or vanishing edge is that it is not visible and thus it appears to the user that he is within an infinite body of water since there is no appearance of a retaining wall for the pool constricting the water. It is particularly useful where there is a view that is desirably seen while the user is in the pool or while the user is lounging at the side of the pool because there is no blockage of the view by a visible water retaining edge extending above the water surface.

Heretofore, the feature has not been available in portable hot tubs or spas which are manufactured at a manufacturing location and conveyed to the place of installation. This is so because, whereas with a swimming pool permanently assembled at the place of installation, there was no difficulty with water recirculation to the pool from the overflowing water. The water flowing over the vanishing edge was simply recirculated into the pool circulation system and then outputted into the pool water inlet. Because pools are much larger than hot tubs and hold commensurately much greater quantities of water, the amount of water displaced by a user or users in proportion to the total quantity of water in the pool is relatively small which has no disadvantageous effect on water circulation. However, in hot tubs, the amount of water displaced by a user or user is much greater proportionately than that with a pool. Provisions much be made for overcoming the problem of relatively large amounts of water leaving the hot tub and returning that quantity of water to the hot tub over time. These considerations are difficult to deal with in hot tubs or the like with the result that vanishing edges in hot tubs are not in common use.

SUMMARY OF THE INVENTION

According to one aspect of the invention, there is provided a hot tub having a relatively large recessed portion for holding users of said hot tub and water, a first wall surrounding at least a first portion of said large recessed portion and extending upwardly a distance beyond the surface of maximum operating water quantity held in said hot tub, a second wall surrounding a second portion of said large recessed portion, a top of said second wall ordinarily being beneath said surface of said water held by said large recessed portion under operating conditions and allowing said water to flow over the top of said second wall during normal operation of said hot tub, a catch basin associated with said top of said second wall, said catch basin being of a size considerably smaller than said large recessed portion, said catch basin having a catch basin wall with a top to retain said water overflowing from said second wall, said top of said catch basin wall being lower than the height of said second wall and a reservoir being of a size to hold the water exiting from said large recessed portion into said catch basin when said water is displaced into said catch basin by users of said hot tub. The hot tub is portable

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

It will initially be understood that throughout this specification, the terms "spa" and "hot tub" are used interchangeably. The term "spa" is a term generally used in Europe and the term "hot tub" is a term generally used in North America. Both terms refer to a tub of generally warm or hot water in which a plurality of users, generally four (4) or less, sit and enjoy the hot water within the spa which water is circulating within the spa and which causes currents impinging on the bodies of the user in a generally favorable and/or therapeutic configuration.

Figure 1:
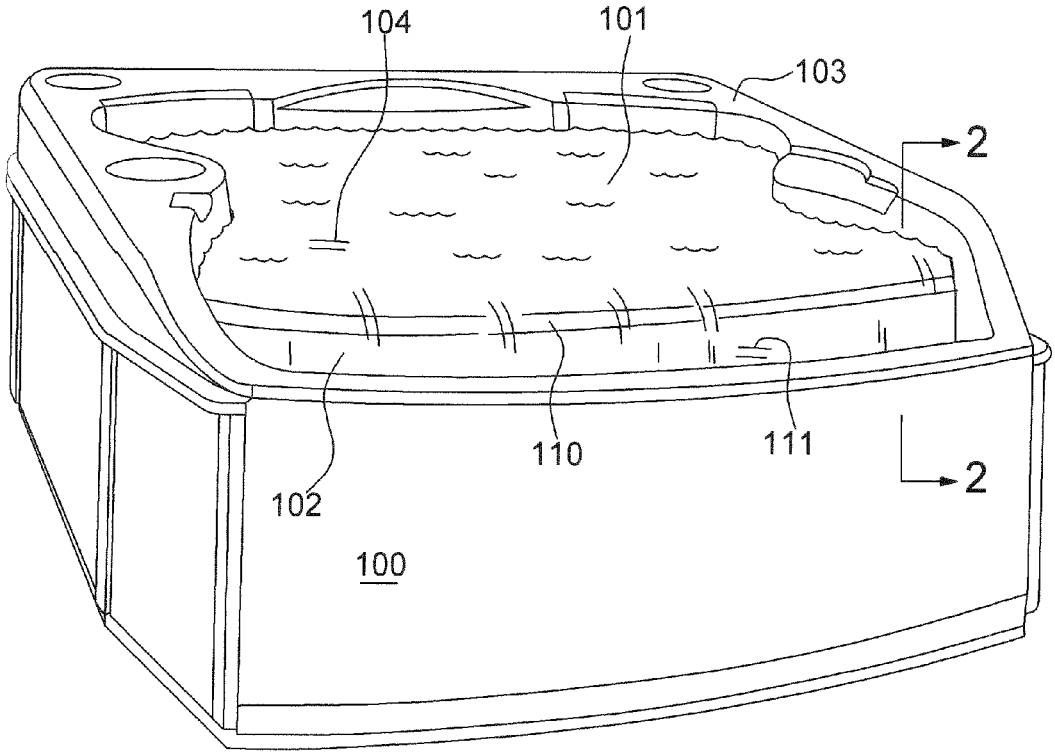
FIG. 1 is an isometric view of a hot tub or spa with a vanishing or negative edge according to the present invention.
Figure 2:
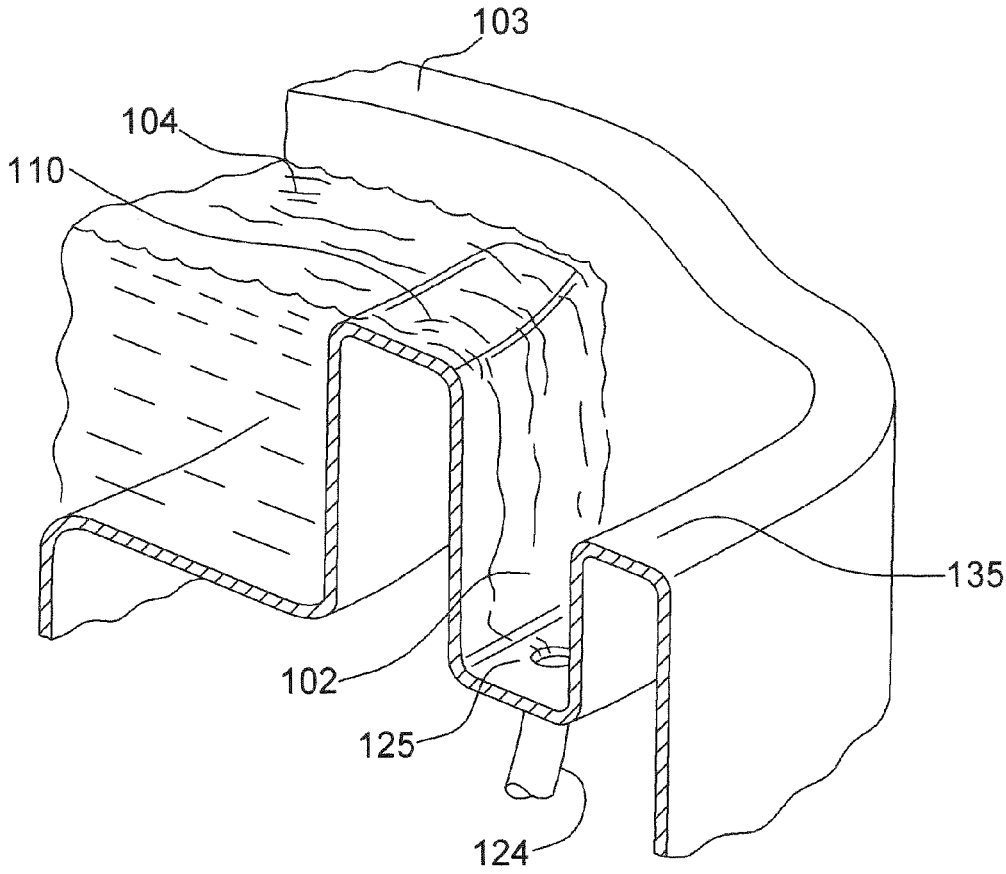
FIG. 2 is a diagrammatic side and sectioned view of the hot tub or spa particularly showing the catch basin according to the invention.

Referring now to the drawings, a spa is generally illustrated at 100 in FIG. 1. The spa 100 includes a generally relatively large recessed portion 101 which holds a relatively large quantity of water and an overflow catch basin 102 which holds water overflowing from the large recessed portion 101.

The large recessed portion 101 includes a first edge 103 as is known. The first edge 103 surrounds a good portion of the perimeter of the recessed portion 101 to hold the water within the recessed portion 101. Typically, the first edge 103 is approximately four and one-half inches (4½ inches) above the water surface 104 which height has been found sufficient to hold a substantial portion of the water and to prevent overflow when a plurality of users are sitting within the recessed portion 101 and displacing water therein.

A second edge 110 surrounds the remaining area of the large recessed portion 101. The second edge 110, commonly known as a "vanishing edge" or as a "negative edge" in the trade is located below the first edge portion 103 and slightly below the water surface 104 thereby to generally be unnoticed by or not visible to a user since the second edge 110 is hidden by the water overflowing the second edge 110. Accordingly, the users will see no edge surrounding a portion of the large recessed area 101 which is an attractive feature of the hot tube or spa 100.

The water overflowing second edge 110 falls into a catch basin generally illustrated at 102 which includes a wall 125 having a top 135. Catch basin 102 is of a size considerably smaller than the larger recessed portion 101 and is designed to hold a sufficient quantity of water that overflows the edge 110 from the large recessed portion 101 when the maximum number of users for which the spa 100 was designed enter the spa 100 and displace their body weight in water or substantially so which quantity of water displaced flows over the second edge or lip 110 and enters into the catch basin 102. It is of a capacity that the water displaced will not overflow from the catch basin 102 unless an unusual number of people enter the spa 100 simultaneously in which event it is possible that a quantity of water will overflow the catch basin 102 to the ground or area surrounding the hot tub 100.

Figure 3:
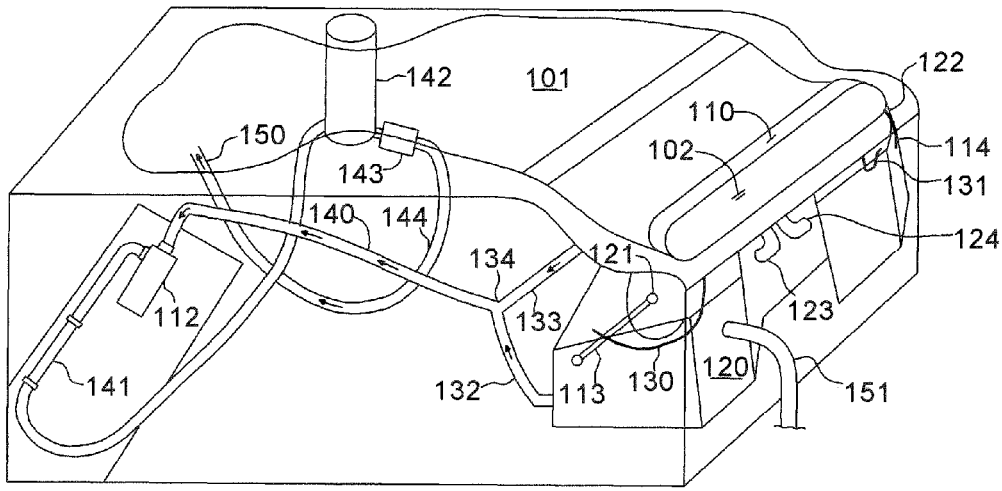
FIG. 3 is a diagrammatic partial view of a hot tub or spa particularly illustrating the vanishing edge, the catch basin, the reservoir and the water lines used for water circulation.
Figure 4:
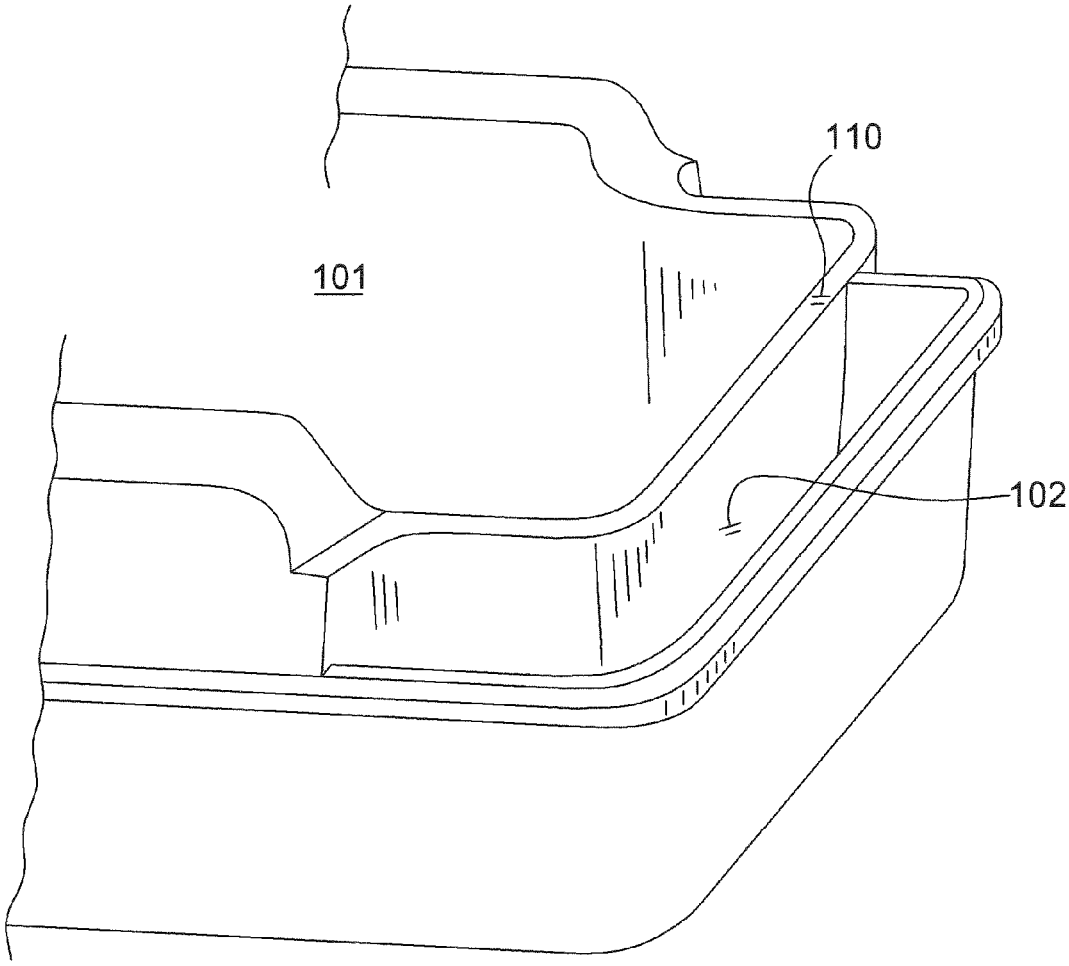
FIG. 4 is a diagrammatic isometric partial view of the hot tub or spa with its catch basin in a further embodiment.

It is important to avoid air entering into the water lines which lead into the water pump 112 (FIG. 3). This is so because an air lock can result which will terminate the pumping action of the pump 112 with the result that water circulation stops and proper use of the hot tub 100 is no longer available. To that end, first drain lines 123, 124, conveniently each being 2 inches in diameter, lead from the bottom of the catch basin 102 to a water holding reservoir 120. The inlets for each of the drain lines 123, 124, respectively, are located in the bottom of the catch basin 102 and the water exits from the catch basin 102 directly to the reservoir 120 through the drain lines 123, 124. Two additional drain lines, namely second drain lines 113, 114 exit from the catch basin 102 to the reservoir 120 but the inlets 121, 122 for each of these additional drain lines 113, 114 are located above the bottom of the catch basin 102 approximately one-half the height of the catch basin 102. This multi-level drain system will allow water to continue to flow to the reservoir 120 from the catch basin 102 even if the catch basin 102 is filled with leaves and/or other debris which blocks the main drains in the bottom of the catch basin 102 leading to drain lines 123, 124. Breathers 130, 131 are provided which extend from the reservoir 120 to the catch basin 102 and which are exposed to atmospheric conditions. The use of the breathers 130, 131 prevents any pressure buildup in the reservoir 120 which pressure buildup could hinder the otherwise continuous flow of water to the pump 112 from the reservoir 120 and the flow of water from the catch basin 102 to the reservoir 120.

Two return lines 132, 133, each being approximately 1 and ½ inches in diameter, lead from the bottom of the reservoir 120 and are teed together at 134. From there, a pump return line 140, conveniently having a diameter of 2 inches, runs to pump 112 carrying the water. Pump 112 recirculates the water through line 141 which runs to spa filter 142, conveniently located as shown although other positions are available and useful. A one way check valve 143 allows water from the filter 142 to flow only in one direction, namely through line 144 to jets or water exit orifices diagrammatically illustrated at 150 which fill the large recessed portion 101 with cleansed water. Water falls may also be used in addition to or in combination with the jets 150.

The size of the catch basin 102 and the reservoir 120 which holds the water received from the catch basin 102 will be designed in conjunction with the size of the hot tub or spa 100. Clearly, a smaller hot tub 100 which is manufactured for a small number of users will require a smaller reservoir 120 since the quantity of water which is displaced by the user or users within a smaller hot tub 100 will be smaller. The reservoir 120 is designed to always maintain a certain head of water therein when the spa 100 is operating. This is so because there may be times when no water is flowing from the catch basin 102 to the reservoir 120 such as when users leave the spa 100 and the water surface 104 within the large recessed portion 101 drops below the level of the second edge 110. In such event, in order to maintain full water flow through line 140 to pump 112, the head within the reservoir 120 will be such that the water quantity is sufficient to properly feed pump 112 until the water surface 104 returns to its normal level and water again flows over edge 110 into catch basin 102 and thence into the reservoir 120 providing additional water for pump 112. Of course, it is possible to create an air lock within pump 112 if, for example, a large number of users quickly enter the tub 100 and displace a large quantity of water over the second edge 110 and the catch basin 102 and, perhaps, over even the first edge 103. This water is then lost to normal operation of the spa 100. This is caused by abnormal operation of the spa 100 and is not its intended operation. In this event, replacement water from an external source will be necessary to return the volume of water to its original quantity.

EXAMPLE OF RESERVOIR DESIGN

A typical example of a spa 100 used for four users in a comfortable and large recessed portion 101 would be to have a reservoir 120 of a capacity to hold approximately one-hundred fifteen (115) imperial gallons of water with a height of approximately 17 inches which height has been found to conveniently fit beneath the catch basin 102. A water quantity of thirty (30) imperial gallons is designed to maintain a height of approximately 4½ inches of the 17 inch total height of the reservoir 120. The usual flow over the second or vanishing edge 110 is designed not to accumulate in the catch basin 102 and moves directly through lines 123, 124 emanating from the bottom of the catch basis 102 to the reservoir 120. The catch basin 102 is of a size such that it will accept about an extra twenty-four (24) imperial gallons above the regular flow of the spa 100 over the vanishing or second edge 110. This amount is the equivalent of the water displacement caused by the immersion of one average sized person in the spa 100. The reservoir 120, however, will hold an additional eighty-five (85) imperial gallons. Thus, four (4) individuals displacing approximately 100 gallons from the large recessed portion 101 will continue to enjoy the spa without water overflowing onto the ground or environment surrounding the spa 100. The breather lines 130, 131 act to prevent pressure buildup in the reservoir 120. If required, an emergency overflow line 151 (FIG. 3) allows the reservoir 120 to overflow to the ground or environment surrounding the hot tub 100 in the event the lines proceeding to pump 112 become blocked or in the event the water displaced from the large recessed portion 101 is greater than that for which the spa 100 was designed.

Operation

In operation, the spa 100 is carrying water within the large recessed portion 101 and the pump 112 is switched on. Reserve water held by the reservoir 120 will run from the reservoir 120 to the pump 112 and thence to the large recessed portion 101 where the water quantity held will increase until the water begins to overflow the vanishing or second edge 110.

The overflow water enters into the catch basin 102 and the water exits from the catch basin 102 to the reservoir 120 thereby to be returned once again to pump 112. When a user or users enters the spa 100, the water overflowing the vanishing or second edge 110 will increase and the catch basin 102 is of a size to hold a quantity of this water while it exits the catch basin 102 under gravity flow to the reservoir 120 which, likewise, is of a size to hold the increased volume of water displaced by the users entering the hot tub or spa 100.

When the users exit from the hot tub 100, the water level will drop below the vanishing or second edge 110 and the catch basin 102 will, for a temporary duration, be empty. The reservoir 120, however, is of such a size that water continues to flow to the pump 112 until, once again, water overflows the vanishing or second edge 110, proceeds into the catch basin 102 and enters the reservoir 120 thence to be circulated through pump 112 and into the large recessed holding area 101.

The reservoir 120 can, of course, be a single water holding tank as is illustrated or, alternatively, it can be a series of interconnected tanks which are appropriately joined together. The reservoir 120 can be located wherever there is appropriate room available for the location of those tanks. It is intended, of course, that the reservoir tanks 120 are manufactured with the spa 100 and that the spa 100 and the tanks 120 are moved together from the place of manufacture to the place of installation, the spa 100 and tanks 120 being intended to be fully portable. However, in some cases, it may be appropriate to install the reservoir tanks 120 to operate in conjunction with the spa 100 at the place of installation although this is an unusual configuration.

While only a partial negative or vanishing edge has been disclosed, it is contemplated that such an edge may extend around the entire periphery of the tub or spa or around a portion thereof which will thereby allowing an unobstructed view in any chosen direction.

Many further modifications will readily occur to those skilled in the art to which the invention relates and the specific embodiments and modifications herein described are intended to be examples of the invention only and not to limit its scope as defined in accordance with the accompanying claims.

We claim:

1. A hot tub, comprising:

(a) a relatively large recessed portion for holding users of said hot tub and water, (b) a first wall surrounding at least a first portion of said large recessed portion and extending upwardly a distance beyond the surface of maximum operating water quantity held in said hot tub, (c) a second wall surrounding a second portion of said large recessed portion, a top of said second wall ordinarily being beneath said surface of said water held by said large recessed portion under operating conditions, and allowing said water to flow over the top of said second wall during normal operation of said hot tub to form a vanishing edge, (d) a catch basin associated with said second wall to catch said water overflowing said top of said second wall, said catch basin being of a size considerably smaller than said large recessed portion, said catch basin having a catch basin wall with a top to retain said water overflowing from said second wall, said top of said catch basin wall being lower than a top of said second wall; and (e) a reservoir coupled to said catch basin to receive water flowing out of said catch basin being of a size to hold fluctuations in the water exiting from said large recessed portion into said catch basin when said water is displaced into said catch basin by users of said hot tub;

(f) at least one pump return line between said reservoir and a pump operable to circulate said water within said hot tub;

(g) a pump line between said pump and said large recessed portion to carry said water returned to said hot tub from said reservoir;

(h) water exit orifices which return water to said hot tub;

(i) a filter and a check valve between said pump and said jets;

Wherein said hot tub is portable.

2. The hot tub as in claim 1 wherein said catch basin has a first drain line leaving from the bottom of said catch basin and extending to said reservoir.

3. The hot tub as in claim 2 and further comprising a second drain line extending from a position somewhat above the bottom of said catch basin and extending to said reservoir.

4. The hot tub as in claim 3 and further comprising air breather lines extending from said reservoir to the atmosphere to allow said pressure within said reservoir to be maintained at atmospheric pressure.

5. The hot tub as in claim 4 wherein said catch basin is of a size to hold the water displaced by a predetermined number of users.

6. The hot tub as in claim 5, wherein said reservoir is of a size to hold a constant head of water and a further quantity displaced by a predetermined number of users.

* * * * *